United States Patent [19]

Ogura et al.

[11] 4,128,068

[45] Dec. 5, 1978

[54] FLOATING-REFUSE-COLLECTING BOAT

[75] Inventors: Hajime Ogura; Haruma Asakawa; Junichi Kondoh, all of Yokohama; Masashi Nakamura, Isehara; Sadamu Oyaide, Yokohama, all of Japan

[73] Assignee: Mitsubishi Jukogyo Kabushiki Kaisha, Tokyo, Japan

[21] Appl. No.: 813,251

[22] Filed: Jul. 6, 1977

[30] Foreign Application Priority Data

Jul. 10, 1976 [JP] Japan ..... 51-82310

[51] Int. Cl.[2] ..... B63B 35/32

[52] U.S. Cl. ..... 114/26; 210/242 S

[58] Field of Search ..... 114/61, 73, 270, 26; 9/1.1; 210/DIG. 25–DIG. 27, 242 R, 242 S

[56] References Cited

U.S. PATENT DOCUMENTS

| | | | |
|---|---|---|---|
| 3,348,690 | 10/1967 | Cornelissen | 210/DIG. 25 |
| 3,561,601 | 2/1971 | McNeely | 114/270 |
| 3,708,070 | 1/1973 | Bell | 210/DIG. 25 |
| 4,033,869 | 7/1977 | McGrew | 210/DIG. 25 |

*Primary Examiner*—Trygve M. Blix
*Assistant Examiner*—Sherman D. Basinger
*Attorney, Agent, or Firm*—Toren, McGeady and Stanger

[57] ABSTRACT

A floating-refuse-collecting boat of a twin-hulled construction includes a floating-refuse collector located in the water channel formed between the hulls. A plurality of main water-jet units are installed on the bows of the hulls for directing jets of water rearwardly through the water channel for guiding and forcing the refuse afloat in the vicinity of the entrance into the channel and toward the collector. In addition, a plurality of auxiliary water-jet units are mounted on the hulls rearwardly of the main water-jet units and in front of the collector to provide jets of water which prevents refuse from flowing out of the collector when the boat moves astern.

5 Claims, 5 Drawing Figures

FLOATING-REFUSE-COLLECTING BOAT

This invention relates to a vessel for collecting floating refuse from the surfaces of harbors, rivers and other bodies of water.

Floating-refuse-collecting boats of conventional design include, for example, the twin-hulled vessels equipped with a rotor between the bows of the hulls to gather waterborne solid wastes located in front of the vessel and direct then into the interhull water channel and then into a collector positioned in the channel. Another example is a vessel for directly hauling or scooping up the refuse afloat by a bow conveyor or rotary bucket. These known vessels have common problems of high maintenance cost in addition to the necessity of most careful inspection and maintenance because of the complexities of their mechanical drives. Nevertheless, the refuse-collecting efficiencies of those existing vessels are not necessarily high.

The present invention is directed to the solution of these problems and to the provision of a vessel with simplified equipment capable of collecting floating refuse with an adequate efficiency at a low maintenance cost.

The floating-refuse-collecting boat according to the invention is characterized by a floating-refuse collector carried in a water channel formed co-extensive with and between the hulls of a twin-hulled boat. A plurality of main water-jet units are installed on the bows of the hulls and provided jets of water for guiding and forcing the refuse afloat in the vicinity of the entrance, into the channel and toward the collector. Further, a plurality of auxiliary water-jet units are installed on the hulls forwardly of the collector to provide jets of water for preventing the collected refuse from flowing out of the collector when the boat moves astern.

The above and other objects, features, and advantages of the present invention will become more apparent from the following detailed description taken in connection with the accompanying drawings, in which.

Figure 1:
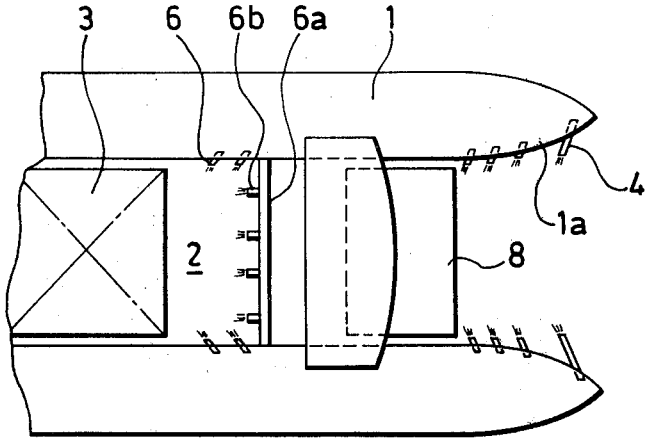
FIG. 1 is a plan view of the essential parts of a floating-refuse-collecting boat embodying the invention.
Figure 2:
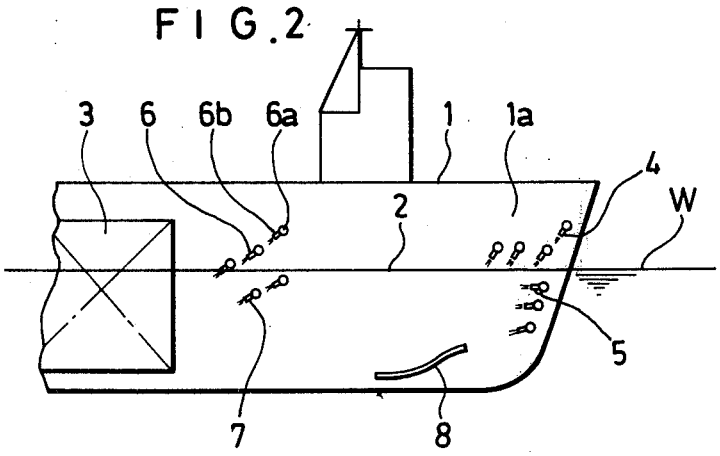
FIG. 2 is a vertical sectional view of the essential parts of FIG. 1.

Referring now to FIGS. 1 and 2, a twin-hulled boat 1 is shown carrying a floating-refuse collector 3 semi-submerged in the water channel 2 formed between the twin hulls. The refuse collector 3, when not in use, can be raised above the water surface W by a crane or other hoist means not shown.

On the walls of the bows 1*a* of the twin hulls opposed to each other, there are installed a plurality of main water-jet units 4, 5, above and below the water level, which eject jets of water to force the refuse afloat in the vicinity of the bows into the interhull channel 2.

Positioned in front of the floating-refuse collector 3 and also mounted on the hulls are a plurality of auxiliary water-jet units 6, 7, located above and below the water, which direct jets of water to retain refuse in the collector 3 when the boat moves backward.

Disposed between and secured to the lower fore parts of the twin hulls is a submerged guide plate 8, which extends across the interhull channel 2 and aids the main water-jet units in inducing the flow of water with floating refuse into the interhull channel 2.

Each of the water-jet units 4 to 7 comprises, for example, a nozzle secured by a ball joint to the hull wall and is supplied with water under pressure through a hose. The direction of the water jet from the nozzle can be changed as desired. As shown in FIG. 1, some of the water-jet units include a turnable or rotatable water pipe 6*a* supported horizontally between the twin hulls with a bank of nozzles 6*b* attached to the pipe.

Figure 3:
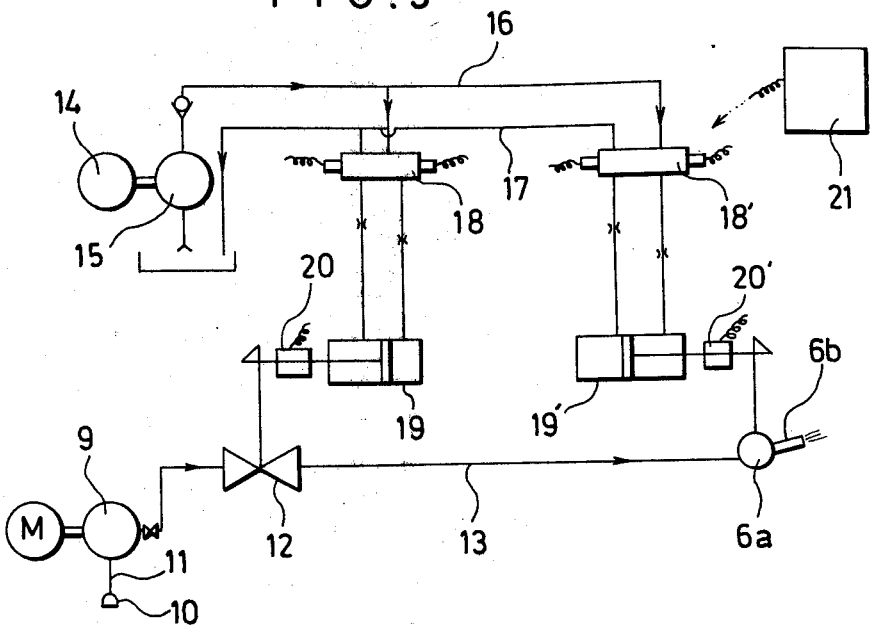

FIG. 3 schematically illustrates a system for controlling the direction of and the quantity of water supplied to the water jets of each unit, for example, of the type consisting of the water pipe 6*a* and nozzles 6*b*.

In the figure there are shown a motor M, a water pump 9, an inlet valve 10, a water suction line 11, a flow control valve 12, and a water line 13, the pump 9 is used to supply water to the nozzles 6*b* and form jets of water.

Controls for the above arrangement include a motor 14, an oil hydraulic pump 15, hydraulic fluid lines 16, 17, solenoid-operated directional control valves 18, 18', actuators 19, 19', a potentiometers 20, 20' with open-close limit switches, and an electric operation stand 21.

Water flow to the water pipe 6*a* is controlled at the electric operation stand 21 by energizing the solenoid-operated directional control valve 18 and conducting the hydraulic pressure to the actuator 19 so that the opening of the flow control valve 12 can be adjusted.

Similarly, the inclination of the bank of nozzles 6*b* can be controlled at the operation stand 21 by actuating the solenoid-operated directional control valve 18' and thereby turning the water pipe 6*a* to a desired angle.

Figure 4:
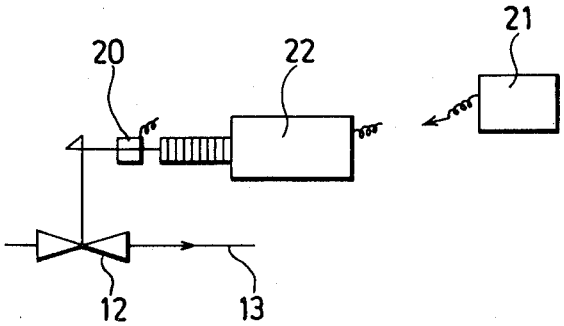
FIGS. 3 to 5 are schematic diagrams of control systems for the water-jet units of the boat according to the invention.

The potentiometer 20 may be directly attached to the flow control valve 12 or, alternatively, as shown in FIG. 4, a rack-and-pinion motor 22 may be used to control the operation of the flow control valve 12 via the potentiometer 20 with an open-close limit switch.

Figure 5:
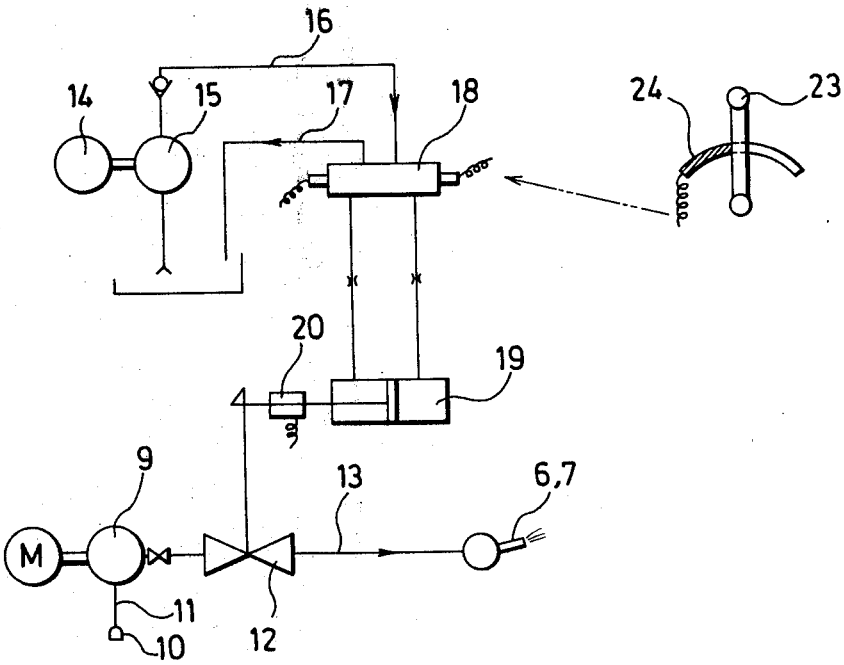

FIG. 5 shows a control system which permits the auxiliary water-jet units 6, 7 to direct jets of water automatically when the boat is moved astern, so that the collected refuse is kept from flowing out of, or is left behind by, the refuse collector of the backing vessel. In this figure the reference numeral 23 designates a main-engine control lever and 24 designates electric contact points. The other numerals like those in FIG. 3 denote like or corresponding parts.

When the lever 23 is in the neutral position the flow control valve 12 is totally closed. As the lever 23 is turned to the backing position, the solenoid-operated directional control valve 18 supplies hydraulic pressure to the actuator 19, so that the flow control valve 12 is fully opened to enable the auxiliary water-jet units 6, 7 to direct jets of water toward the entrance of the floating-refuse collector 3.

With the aforedescribed construction, the floating-refuse-collecting boat of the invention collects refuse from the water surface in the following way. The jets of water from the main water-jet units 4, 5 on the bows 1*a* of the twin hulls are directed inwardly of the interhull channel 2, whereby the refuse afloat in the vicinity of the entrance is positively carried into the channel 2. In this manner floating refuse can be efficiently gathered by the collector 3.

Because the floating-refuse collector 3 is built, for example, as a cage-like receptacle with an open front, a backward motion of the boat can cause an outflow of the collected refuse from the collector due to a counter flow of water. This possibility is eliminated, in accordance with the invention, by the provision of auxiliary water-jet units 6, 7 for the retaining of refuse in the floating-refuse collector 3. While the boat is backing the auxiliary units will continue to give sufficient jets of water to avoid any escape of the collected wastes from the collector.

Moreover, where the floating refuse is too much for the main water-jet units 4, 5 to guide satisfactorily into the collector 3, the auxiliary units 6, 7 may be used to give an additional push for an increased collecting efficiency.

As shown in FIG. 5, shifting the main-engine control lever 23 to the backing position will automatically actuate the auxiliary water-jet units 6, 7, so that the latter can fully exhibit their refuse-containment function.

The directions of jets from the water-jet units 4 to 7 are adjusted to optimum angles according to changes in the draft of the boat. The control is simple, requiring no such elaborate effort as in adjusting the position of a rotor or conveyor aboard the prior art refuse-collecting boats. Of the water-jet units, those installed on the underwater wall portions of the vessel may be eductors.

The pumps to serve the water-jet units 4 to 7 may be newly installed for that exclusive purpose or, as an alternative, the general-purpose pumps originally in use aboard the vessel may be utilized for such units.

The water-jet units 4 to 7, when used in forcing and guiding floating refuse toward the collector, involve no mechanical contact with the refuse as does the conventional refuse-collecting rotor or conveyor. They are, therefore, easy to maintain and helpful in reducing the maintenance cost considerably.

As has been described in detail, the floating-refuse-collecting boat according to this invention uses main water-jet units installed on the bows of the twin hulls, whereby solid wastes afloat can be efficiently gathered into the waterway or channel formed between the twin hulls of the boat. The refuse thus trapped by the collector has no chance of escaping during a backward motion of the boat because the auxiliary units issue sufficient jets of water to keep the refuse contained. With these functions combined, the boat incorporating the present invention is capable of collecting waterborne solid wastes with an extremely high efficiency.

What is claimed is:

1. A floating-refuse-collecting boat comprising a twin hull arranged to float in the water having a water level with a portion of said twin hull located above the water level and the remaining part below the water level and including a pair of hulls each having a fore end and an aft end with the fore ends and aft ends positioned opposite one another and with said hulls spaced laterally apart and forming therebetween a water channel extending from the fore ends to the aft ends of said twin hull, a floating-refuse collector having a fore end and an aft end, said collector located in said water channel between said pair of hulls, the fore end of said collector spaced from the fore ends of said hulls in the direction toward the aft ends thereof, said fore end of said collector being open for receiving floating refuse flowing into said water channel, a plurality of main water-jet units mounted on the fore ends of each of said hulls forwardly of the fore end of said collector and arranged to direct jets of water into said water channel generally rearwardly toward the fore end of said collector, said main water-jet units located on said hull both above and below the water level, a plurality of auxiliary water-jet units mounted on said twin hull and located rearwardly of said main water-jet units and forwardly of the fore end of said collector and arranged to direct jets of water into said water channel toward the fore end of said collector for preventing refuse within said collector from flowing out of the fore end thereof when said boat moves astern, and a guide plate extending transversely between said pair of hulls across the water channel therebetween and below the water level of said hulls and said guide plate located rearwardly of said main water-jet units and forwardly of said auxiliary water-jet units, said guide plate arranged to aid said main water-jet units in inducing the flow of water with floating refuse into said water channel toward the fore end of said collector.

2. A floating-refuse-collecting boat, as set forth in claim 1, including means connected to said main water-jet units and auxiliary water-jet units for controlling the direction of the jets of water.

3. A floating-refuse-collecting boat, as set forth in claim 1, including means connected to said main water-jet units and auxiliary water-jet units for controlling the amount of water supplied thereto.

4. A floating-refuse-collecting boat, as set forth in claim 1, including means connected to said auxiliary water-jet units for automatically supplying water thereto when said boat moves astern.

5. A floating-refuse-collecting boat, as set forth in claim 1, wherein said auxiliary water-jet units include a water pipe extending transversely across said water channel above the water level on said twin hulls, a plurality of nozzles located in said water pipe for flowing a jet of water from each of the nozzles toward the fore end of said collector and said water pipe being rotatably mounted in said twin hulls for selectively directing the jets of water toward the fore end of said collector.

* * * * *